US005809973A

United States Patent [19]

Iida et al.

[11] Patent Number: 5,809,973

[45] Date of Patent: Sep. 22, 1998

[54] CONTROL DEVICE AND CONTROL METHOD FOR INTERNAL-COMBUSTION ENGINE

[75] Inventors: Kazumasa Iida, Kyoto; Masato Yoshida, Nagaokakyo; Hiroki Tamura, Hoi-gun; Toshiro Nomura, Okazaki; Hitoshi Kamura, Kyoto; Kazuchika Tashima, Anjo; Atsuyoshi Kojima, Toyota, all of Japan

[73] Assignee: Mitsubishi Jidosha Kogyo Kabushiki Kaisha, Tokyo, Japan

[21] Appl. No.: 908,382

[22] Filed: Aug. 7, 1997

[30] Foreign Application Priority Data

Aug. 9, 1996 [JP] Japan ..... 8-210807

[51] Int. Cl.[6] ..... F02M 51/00

[52] U.S. Cl. ..... 123/491; 123/179.16

[58] Field of Search ..... 123/491, 179.16, 123/179.17, 481

[56] References Cited

U.S. PATENT DOCUMENTS 3,923,031 12/1975 Keranen ..... 123/179.16
4,867,115 9/1989 Henein .
4,998,522 3/1991 Achleitner ..... 123/491
5,249,560 10/1993 Gian et al. ..... 123/491
5,305,720 4/1994 Ando et al. .
5,690,073 11/1997 Fuwa ..... 123/491
5,690,075 11/1997 Tanaka et al. ..... 123/491

*Primary Examiner*—Thomas N. Moulis

[57] ABSTRACT

When starting of an in-cylinder injection engine 1 is detected, a cylinder discrimination, which discriminates each cylinder, is effected. After each cylinder is discriminated, it is determined whether or not a water temperature detected by a water temperature sensor 16 exceeds a predetermined value. When the water temperature is below the predetermined value, fuel injection is started from the fuel injection valve 4 of a cylinder subjected to at least one compression stroke. Thereby, the cylinder discrimination is effected quickly, and it is made possible to raise the temperature within the combustion chamber 5, by means lapse of at least one compression stroke, at low water temperatures at which the starting ability tends to be deteriorated, and the starting ability of the in-cylinder injection engine 1 at low water temperatures is improved while shortening the starting time.

19 Claims, 3 Drawing Sheets

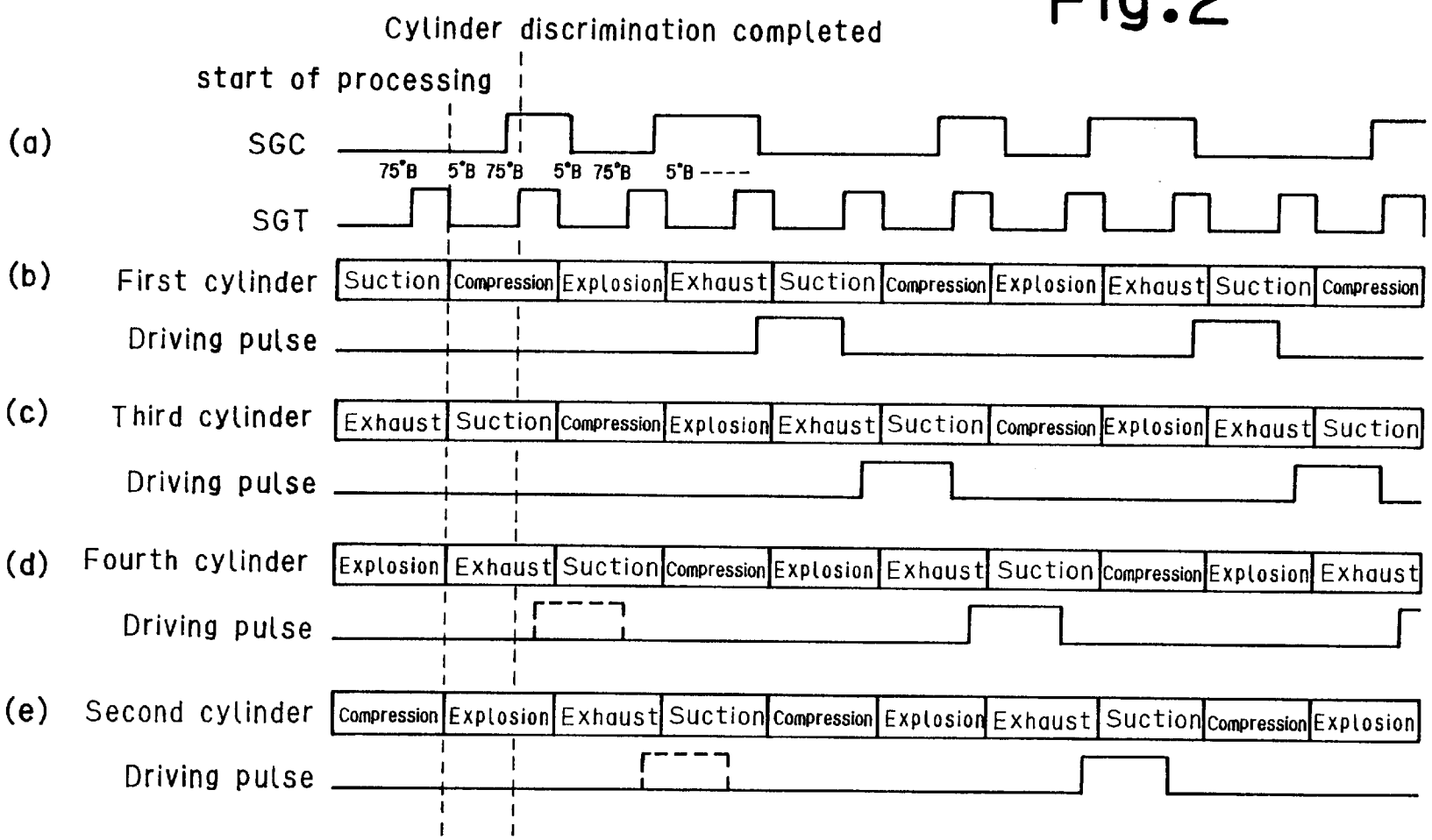
Fig.2
Cylinder discrimination completed
start of processing
(a)
SGC
SGT
75°B 5°B 75°B 5°B 75°B 5°B ----
(b)
First cylinder
Suction Compression Explosion Exhaust Suction Compression Explosion Exhaust Suction Compression
Driving pulse
(c)
Third cylinder
Exhaust Suction Compression Explosion Exhaust Suction Compression Explosion Exhaust Suction
Driving pulse
(d)
Fourth cylinder
Explosion Exhaust Suction Compression Explosion Exhaust Suction Compression Explosion Exhaust
Driving pulse
(e)
Second cylinder
Compression Explosion Exhaust Suction Compression Explosion Exhaust Suction Compression Explosion
Driving pulse

CONTROL DEVICE AND CONTROL METHOD FOR INTERNAL-COMBUSTION ENGINE

BACKGROUND OF THE INVENTION

The present invention relates to a control device and a control method for an internal-combustion engine mounted on an automobile or the like, and more particularly to a control device and a control method intended to improve the starting ability of a multi-cylinder type in-cylinder injection internal-combustion engine adapted to directly inject fuel into a combustion chamber.

In a multi-cylinder type internal-combustion engine (engine) mounted on an automobile or the like, fuel injection control and ignition timing control are effected by discriminating each cylinder. In order to discriminate cylinders, a timing signal (crank angle signal: SGT) of weighted ordinate waveform is generated correspondingly to a predetermined angle position (for example, 75 degrees BTDC and 5 degrees BTDC) of the crankshaft in a predetermined state of the piston in each cylinder, and a wavelike cylinder signal (cylinder discrimination signal: SGC) for effecting cylinder discrimination is generated to combine both wave forms.

On discriminating a cylinder, the state (high level or low level) of cylinder signals corresponding to the leading edge and trailing edge of a timing signal is detected, a cylinder which becomes a reference is discriminated on the basis of information when a combination of state of cylinder signals are, for example, both on a high level.

In recent years, in order to reduce harmful emission gas constituents and to improve fuel consumption, various multi-cylinder type in-cylinder injection engines which directly inject fuel into the combustion chamber have been proposed in place of an intake-pipe injection engine which injects fuel into the intake pipe (for example, Japanese Patent Laid-Open Application No. 5-240044).

In the multi-cylinder type in-cylinder injection engine, which is adapted to directly inject fuel into the combustion chamber, it is necessary to discriminate cylinders immediately after starting by means of the aforesaid cylinder discrimination. The engine sequentially injects fuel on the basis of the result of the cylinder discrimination. Thus, by sequentially injecting fuel immediately after starting, it is possible to start the multi-cylinder type in-cylinder injection engine without causing start delay and the like.

In the multi-cylinder type in-cylinder injection engine, fuel is to be injected immediately after starting even if the engine is in a cold state because it discriminates the cylinders immediately after starting to sequentially inject fuel. If fuel is injected into the combustion chamber while the engine is in a too-cold state, the fuel is not vaporized, and causes a smolder to the ignition plug or causes a non-ignition condition. There is a possibility that the fuel is not ignited, and unburned fuel is discharged from the combustion chamber and deteriorates the exhaust gas performance.

Also, on the other hand, when the cylinder discrimination is effected immediately after starting to initiate sequential fuel injection, the demanded injection quantity cannot be attained because the fuel pressure is low at the time of starting. In other words, the demanded injection quantity is generally determined by the fuel pressure in the delivery pipe adjusted to a set fuel pressure by a regulator, a fuel pressure detected by a fuel pressure sensor provided within the delivery pipe, and the valve open time for the fuel injection valve. Therefore, if valve open time previously determined by the anticipated set fuel pressure set by the regulator is used, the demanded injection quantity becomes insufficient when the actual fuel pressure is low, and if corrected valve open time corresponding to the low fuel pressure detected by a fuel pressure sensor is used, the valve open time will become long, and during the period of time, the intake valve will be closed, resulting in insufficient demanded injection quantity. For example, there may be some cases where only one-third to half the demanded fuel quantity can be supplied into the combustion chamber. Therefore, when the fuel injection is started immediately after starting, there is a possibility that the starting ability is deteriorated even at this point.

Thus, as means for effecting fuel injection control in a diesel engine, which does not exhaust incombustible fuel, undesirable particles, gas, and the like when starting, particularly, at low temperatures, a technique as described in, for example, U.S. Pat. No. 4,867,115 is known. The diesel engine described in the aforesaid prior art is provided with a device for delaying the injection of fuel into a cylinder 12 for a predetermined period of time after starting of the engine to prevent a large quantity of fuel from being supplied to the cylinder 12. This delay time is a specific time period required until one or more engine operation parameters such as, for example, engine rotation speed, rotation angle of crankshaft 9 or one or more of gas compression pressure of a cylinder reach predetermined levels. According to the aforesaid structure of the engine disclosed in the foregoing prior art, such injection of fuel into the cylinder 12 prevents an accidental fire or an insufficient combustion so that no unburned carbon hydride, fuel, or liquid and solid particles due to the accidental fire or the insufficient combustion are released from the engine and minimize the generation of white smoke, and reaching the cylinder walls and crankcase to dilute the lubricating oil, thus reducing the wear on the engine.

In the foregoing prior art, however, the aforesaid delay time is represented only by specified time until the engine rotation speed, the rotation angle of the crankshaft 9, or the gas compression pressure of the cylinder reach the respective predetermined levels, and the delay time is not set as an optimum, concrete time period.

Also, in the aforesaid prior art a fuel injection pump peculiar to a diesel engine is used. In the fuel injection pump 16, in which fuel is compressed by one pump unit, the aforesaid compressed fuel is distributed into each cylinder by a distributor to inject fuel close to the top dead point of compression stroke of each cylinder respectively. In this case, however, the cylinder discrimination, which determines the stroke stage of respective cylinders, is not effected.

As a result, if the delay time is too short, there is a possibility that the fuel is injected into a cylinder, which is not in to a compression stroke, at low temperatures because the cylinder discrimination is not effected, and thus incombustible fuel, undesirable particles, gas, and the like will be exhausted.

On the other hand, while there is a cylinder capable of starting fuel injection, among a plurality of cylinders, the time delay is simply set as a predetermined time after starting of the engine and no cylinder discrimination is effected. Therefore, the aforesaid delay time becomes too long or becomes irregular, thus making the engine distrustful to a driver. Also, when the aforesaid delay time becomes too long, the driving time of a sel-motor becomes long, thus increasing the power consumption.

The present invention has been achieved in the light of the aforesaid conditions, and its object is to provide a control device and a control method for an internal-combustion engine capable of maintaining a satisfactory starting ability when starting, particularly when starting at low temperatures.

SUMMARY OF THE INVENTION

In order to achieve the aforesaid object, a control device for an internal-combustion engine according to the present invention is characterized by comprising: fuel supply means for supplying fuel into combustion chambers for each cylinder of a multi-cylinder type internal-combustion engine respectively; fuel control means for controlling the fuel supply means on the basis of the operating condition of the internal-combustion engine; start detection means for detecting commencement of starting of the internal-combustion engine; cylinder discrimination means for discriminating cylinders on the basis of timing signals at predetermined crank angle positions corresponding to the cylinders; and temperature detection means for detecting engine temperature of the internal-combustion engine, the fuel control means having starting injection commencement control means for staring fuel injection from a fuel-suppliable cylinder after cylinder discrimination is completed by the cylinder discrimination means at the commencement of starting of the internal-combustion engine, wherein the starting injection commencement control means controls, at the commencement of starting the internal-combustion engine, the fuel supply means so as to start fuel injection from a fuel-suppliable cylinder on the basis of cylinder discrimination carried out by the cylinder discrimination means when the engine temperature detected by the temperature detection means exceeds a predetermined temperature, and to start fuel injection from a fuel-suppliable cylinder subjected to at least one compression stroke on the basis of the cylinder discrimination after the cylinder discrimination carried out by the cylinder discrimination means when the engine temperature detected by the temperature detection means is below the predetermined temperature.

Since, therefore, the internal-combustion engine is arranged to start fuel injection immediately when the engine temperature exceeds the predetermined temperature after the cylinder discrimination, the internal-combustion engine can be started quickly and surely.

Also, since the internal-combustion engine is arranged to start fuel injection from a cylinder subjected to at least one compression stroke even if the engine temperature is below the predetermined temperature, it is possible to raise the temperature within the combustion chamber effectively by the inclusion of a compression stroke which is easy to obtain effect of temperature rising. As a result, it becomes possible to securely improve the starting ability of the internal-combustion engine.

Firstly, the fuel control means is characterized in that, subsequently to a cylinder in which fuel injection is started by controlling the fuel supply means by the starting injection commencement control means at the commencement of starting of the internal-combustion engine, the fuel control means controls the fuel supply means so as to sequentially inject fuel from a next fuel-suppliable cylinder discriminated by the cylinder discrimination means.

Secondly, the starting injection commencement control means is characterized in that it controls the fuel supply means so as to start fuel injection from a second fuel-suppliable cylinder after the completion of cylinder discrimination when the engine temperature is below the predetermined temperature.

Thirdly, the internal-combustion engine is characterized in that it has N pieces of cylinders and that the starting injection commencement control means has count means for counting a number of fuel-suppliable cylinders after the completion of cylinder discrimination when the engine temperature is below the predetermined temperature, and the starting injection commencement control means controls the fuel supply means so as to start fuel injection from a [(N/2)+1]th fuel-suppliable cylinder.

Fourthly, the internal-combustion engine is characterized in that it is a four-stroke internal-combustion engine including each stroke of suction, compression, expansion and exhaust, and that the starting injection commencement control means discriminates, in cylinders for which the cylinder discrimination has been effected after the completion of the cylinder discrimination when the engine temperature is below the predetermined temperature, at least two strokes of the strokes of the aforesaid suction, compression, expansion and exhaust, and thereafter controls the fuel supply means so as to start fuel injection from the fuel-suppliable cylinder discriminated by the cylinder discrimination means.

Fifthly, the starting injection commencement control means is characterized in that it sets a supply stop period until the start of fuel injection is allowed on the basis of the engine temperature at the commencement of starting of the internal-combustion engine, and controls the fuel supply means so as to start fuel injection from the fuel-suppliable cylinder discriminated by the cylinder discrimination means after a lapse of the supply stop period after the completion of the cylinder discrimination.

Sixthly, the internal-combustion engine is characterized in that it is a four-stroke internal-combustion engine including each stroke of suction, compression, expansion and exhaust, and that the supply stop period is a number of strokes of each stroke of the aforesaid suction, compression, expansion and exhaust.

Seventhly, the supply stop period is characterized by being a number of times of compression strokes of a cylinder subjected to a first compression stroke after the completion of cylinder discrimination.

Eighthly, a control device for an internal-combustion engine is characterized in that the internal-combustion engine is provided with fuel transport means, the fuel transport means includes a first fuel pump for delivering fuel, via a fuel passage, to delivery pipe connected to the fuel supply means, and a first regulator disposed in the fuel passage downstream of the first fuel pump and for adjusting pressure of fuel delivered by the first fuel pump to a first set pressure, and the starting injection commencement control means allows fuel injection after a lapse of a predetermined period until fuel pressure within the delivery pipe reaches the first set pressure.

Ninthly, the fuel transport means is characterized in that it includes a second fuel pump provided midway in the fuel passage between the delivery pipe and the first regulator, for delivering fuel pressure-adjusted by the first regulator; a second regulator provided in the fuel passage downstream of the second fuel pump, for adjusting fuel delivered by the second fuel pump to a second set pressure higher than the first set pressure; and a fuel pressure control valve provided in a by-pass passage for bypassing the second regulator in the fuel passage downstream of the second fuel pump, for being opened or closed electrically, so as to release the fuel pressure control valve in a specified operating state including during starting of the internal-combustion engine and to control the fuel pressure within the delivery pipe from the second set pressure to the first set pressure.

Tenthly, the fuel supply means has an injector capable of directly supplying fuel into the combustion chamber, and the internal-combustion engine is operable in a compression stroke injection mode for mainly injecting fuel in the compression stroke and in a suction stroke injection mode for mainly injecting fuel in the suction stroke, and is provided with injection mode selection means for selecting either the compression stroke injection mode or the suction stroke injection mode depending on the operating condition of the internal-combustion engine, and the injection mode selection means selects the suction stroke injection mode when commencement of starting of the internal-combustion engine is detected by the start detection means, and the fuel control means sets the valve opening time of the injector on the basis of the demand injection quantity corresponding to a target air-fuel ratio, and the first set pressure at the commencement of starting of the internal-combustion engine.

Accordingly, since design is made such that there is provided, as the fuel supply means, an injector for directly supplying fuel into the combustion chamber and fuel is injected in the compression stroke or in the suction stroke, it is possible to inject required fuel quantity from a desired cylinder without injecting any futile fuel.

In order to achieve the aforesaid object, a control method for an internal-combustion engine according to the present invention comprises, in a control method for an internal-combustion engine provided with fuel supply means for supplying fuel into combustion chambers for each cylinder of a multi-cylinder type internal-combustion engine respectively, and with fuel control means for controlling the fuel supply means on the basis of the operating condition of the internal-combustion engine, the steps of:

(a) detecting commencement of starting of the internal-combustion engine;

(b) discriminating cylinder on the basis of timing signals at the predetermined crank angle positions corresponding to the cylinders;

(c) detecting the engine temperatures of the internal-combustion engine;

(d1) when the engine temperature detected in the step, (c) is below predetermined temperature after commencement of starting of the internal-combustion engine is detected in the step (a), discriminating a fuel-suppliable cylinder subjected to at least one compression stroke after the cylinder discrimination carried out in the step (b), and further identifying the fuel-suppliable cylinder as a fuel-supply starting cylinder; and (e) controlling the fuel supply means so as to effect fuel injection from the fuel-supply starting cylinder identified in the step (d1).

Therefore, fuel injection is started from the cylinder subjected to at least one compression stroke even if the engine temperature is below the predetermined temperature, and it is possible to raise the temperature within the combustion chamber effectively by the inclusion of a compression stroke which is easy to obtain effect of temperature rising. As a result, it becomes possible to securely improve the starting ability of the internal-combustion engine.

Firstly, in a control method for the aforesaid internal-combustion engine, the step (d1) includes the following step:

(d2) discriminating a second fuel suppliable cylinder after the cylinder discrimination carried out in the step (b), and further identifying the second fuel suppliable cylinder as the fuel-supply starting cylinder.

Secondly, in a control method for the aforesaid internal-combustion engine, the internal-combustion engine has N pieces of cylinders, and the step (d1) further includes the following step:

(d3) counting a number of fuel suppliable cylinders after the cylinder identification carried out the step (b), discriminating the [(N/2)+1]th fuel suppliable cylinder, and further identifying the aforesaid [(N/2)+1]th cylinder as the fuel-supply starting cylinder.

Thirdly, in a control method for the aforesaid multi-cylinder type internal-combustion engine, the step (d1) further includes the following steps:

(f1) setting a supply stop period until fuel injection is allowed on the basis of the engine temperature detected in the step (c);

(f2) counting the supply stop period set in the step (f1) after the cylinder discrimination carried out in the step (b); and (f3) discriminating a fuel-suppliable cylinder on the basis of the cylinder discrimination carried out in the step (b) after the supply stop period has been completed in the step, and identifying the fuel-suppliable cylinder as the fuel-supply starting cylinder.

Fourthly, in a control method for the aforesaid multi-cylinder type internal-combustion engine, the supply stop period in the step (f1) should be a number of strokes for each stroke of suction, compression, expansion and exhaust until fuel injection is allowed on the basis of the engine temperature detected in the step (c).

Fifthly, in a control method for the aforesaid multi-cylinder type internal-combustion engine, the supply stop period in the step (f1) should be a number of times of compression strokes of a cylinder subjected to the first compression stroke after the completion of cylinder discrimination until fuel injection is allowed on the basis of the engine temperature detected in the step (c).

Sixthly, in a control method for the aforesaid multi-cylinder type internal-combustion engine, the step (d1) includes the following steps:

(g1) setting a predetermined period until the fuel pressure in the delivery pipe becomes a first set pressure which is the fuel pressure of the fuel pressure-adjusted by a first regulator, and the predetermined period is a period until fuel injection is allowed;

(g2) counting the predetermined period set in the step (g1) after the cylinder discrimination carried out in the step (b); and (g3) when the counting-completed time in which counting of the predetermined period has been completed in the step (g2) is earlier than injection-starting time at which the fuel-suppliable cylinder subjected to at least one compression stroke on the basis of the cylinder discrimination carried out in the step(b) starts fuel supply, identifying the fuel-suppliable cylinder as a fuel-supply starting cylinder.

Seventhly, in a control method for the aforesaid internal-combustion engine, the step (d1) further includes the following step:

(h) when the engine temperature detected in the step (c) exceeds the predetermined temperature after commencement of starting of the internal-combustion engine is detected in the step (a), identifying the first fuel-suppliable cylinder after the cylinder discrimination carried out in the step (b) as a fuel-supply starting cylinder

BRIEF DESCRIPTION OF THE DRAWINGS

FIG. 2 is an explanatory view illustrating the stroke state of cylinder discrimination and fuel injection.

DETAILED DESCRIPTION OF PREFERRED EMBODIMENT

The description will be made of an embodiment according to the present invention with reference to the drawings hereinafter. The embodiment shown is described by exemplifying a multi-cylinder type in-cylinder injection internal-combustion engine adapted to directly inject fuel into a combustion chamber of the internal-combustion engine.

Figure 1:
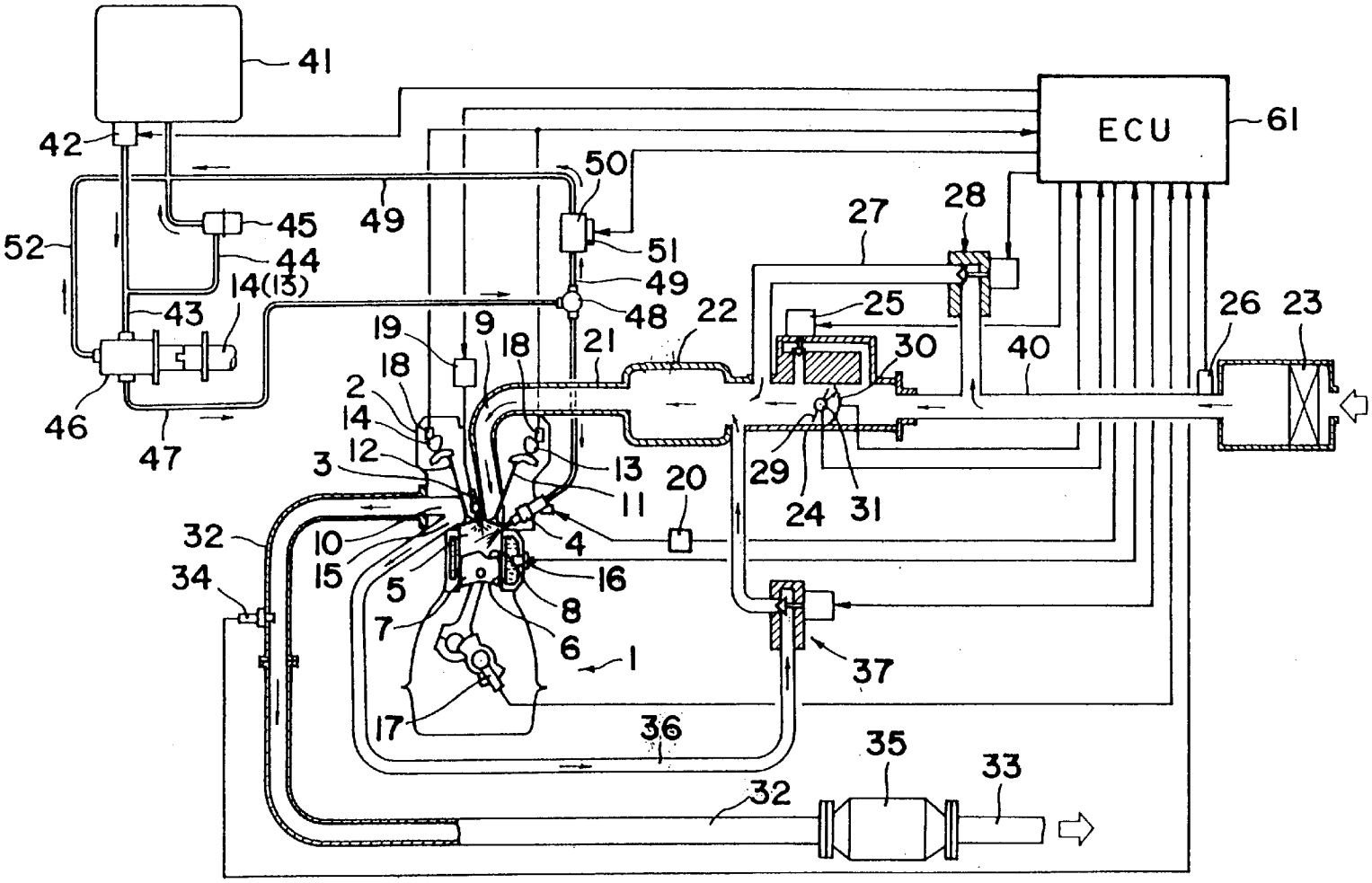
FIG. 1 is a schematic structural view showing a multi-cylinder type in-cylinder injection internal-combustion engine provided with a fuel control device according to an embodiment of the present invention.

The description will be made of the structure of a multi-cylinder type in-cylinder injection internal-combustion engine in conjunction with FIG. 1. As the multi-cylinder type in-cylinder injection internal-combustion engine, for example, an in-cylinder injection type straight four-cylinder gasoline engine (in-cylinder injection engine) 1, which directly injects fuel into a combustion chamber, is applied. In the in-cylinder injection engine 1, the combustion chamber, an intake device, an exhaust gas recirculation system (EGR system) and the like are designed exclusively for in-cylinder injection.

In the in-cylinder injection engine 1, a cylinder head 2 is provided with an ignition plug 3 for each cylinder, and with an electromagnetic type fuel injection valve 4 as the fuel supply means for each cylinder. The combustion chamber 5 is provided with an injection nozzle of the fuel injection valve 4 such that fuel injected from the fuel injection valve 4 through a driver 20 is directly injected into the combustion chamber 5. In a cylinder 6 of the in-cylinder injection engine 1, a piston 7 slidable in an up and down direction, is inserted, and on the top surface of the piston 7, a semi-spherically recessed cavity 8 is formed. The cavity 8 promotes the formation of a vertical gyrating flow due to suction air from an intake port as will be described later.

The cylinder head 2 is formed with an intake port 9 and an exhaust port 10 which face the combustion chamber 5, and the intake port 9 is opened or closed by the driving of the intake valve 11 while the exhaust port 10 is opened or closed by the driving of the exhaust valve 12. On the upper portion of the cylinder head 2, an intake-side cam shaft 13 and an exhaust-side cam shaft 14 are rotatably supported, and the intake valve 11 is driven by the rotation of the intake-side cam shaft 13 while the exhaust valve 12 is driven by the exhaust-side cam shaft 14. On the exhaust port 10, a large diameter exhaust gas recirculation port (EGR port) 15 is branched obliquely downward.

In the vicinity of the cylinder 6 of the in-cylinder injection engine 1, there is provided a water temperature sensor 16 as the temperature detection means for detecting the cooling water temperature. Also, there is provided a vane type crank angle sensor 17 which outputs a crank angle signal SGT at a predetermined crank position (for example, 75 degrees BTDC and 5 degrees BTDC) of each cylinder to detect the engine rotation speed. Also, on cam shafts 13 and 14 which rotate at a revolution speed half of that of the crankshaft, there is provided a discrimination sensor 18 for outputting a cylinder discrimination signal SGC so that the cylinder can be discriminated through the cylinder discrimination signal SGC to which cylinder the crank angle signal SGT corresponds. In this respect, reference numeral 19 in the figure designates an ignition coil which applies high voltage to the ignition plug 3.

To the intake port 9, an intake pipe 40 is connected through an intake manifold 21, and the intake manifold 21 is provided with a surge tank 22. Also, the intake pipe 40 is provided with an air cleaner 23, a throttle body 24, a first air by-pass valve 25 of a stepper motor type, and an air flow sensor 26. The air flow sensor 26 is used to detect an amount of suction air, and for example, a Carman vortex type flow sensor is used. In this respect, a boost pressure sensor can be mounted to the surge tank 22, in place of the air flow sensor 26, to determine the amount of intake air from intake pipe pressure detected by the boost pressure sensor.

On the intake pipe 40, there is provided a large-diameter air by-pass pipe 27 which inhales air into an intake manifold 21 around a throttle body 24, and the air by-pass pipe 27 is provided with a second air by-pass valve 28 of a linear solenoid type. The air by-pass pipe 27 has a passage area in proportion to the intake pipe 40, and inhaling of air of an amount required in the low and medium speed areas of the in-cylinder injection engine 1 is made possible during full opening of the second air by-pass valve 28.

The throttle body 24 is provided with a butterfly throttle valve 29 for opening or closing the passage, and a throttle position sensor 30 for detecting the opening of the throttle valve 29. Also, the throttle body 24 is provided with an idle switch 31 for detecting a full-closed state of the throttle valve 29 to recognize an idling state of the in-cylinder injection engine 1.

On the other hand, to the exhaust port 10, an exhaust pipe 33 is connected through an exhaust manifold 32, to which a $O_2$ sensor 34 is mounted. Also, the exhaust pipe 33 is provided with a catalytic converter rhodium 35 and a silencer (not shown). Also, the EGR port 15 is connected to the intake manifold 21 on the upstream side through the large-diameter EGR pipe 36, which is provided with a EGR valve 37 of stepper motor type.

The fuel in a fuel tank 41 is pumped up by an electrically-driven low-pressure fuel pump 42, and is delivered to the side of the in-cylinder injection engine 1 through a low-pressure feed pipe 43. The fuel pressure within the low-pressure feed pipe 43 is adjusted to a comparatively low pressure (such as about 0.3 MPa) by a first fuel pressure regulator 45 provided in a return pipe 44. The fuel delivered to the side of the in-cylinder injection engine 1 is delivered to each fuel injection valve 4 through a high-pressure feed pipe 47 and a delivery pipe 48 by a high-pressure fuel pump 46.

The high-pressure fuel pump 46 of, for example, a swash plate axial piston type is so arranged to be driven by the cam shaft 14 on the exhaust side or the cam shaft 13 on the intake side to generate a discharge pressure not less than a predetermined pressure even during an idling operation of the in-cylinder injection engine 1. The fuel pressure within the delivery pipe 48 is adjusted to a comparatively high pressure (such as about 5 MPa) by a second fuel pressure regulator 50 provided in a return pipe 49.

The second fuel pressure regulator 50 is mounted with an electromagnetic type fuel pressure selector valve 51, which is capable of releasing fuel in an ON-state to reduce the fuel pressure within the delivery pipe 48 into low fuel pressure. In this respect, reference numeral 52 in the figure designates a return pipe for returning a part of fuel utilized for lubrication or cooling for the high-pressure fuel pump 46 to the fuel tank 41.

A vehicle is provided with an electronic control unit (ECU) 61 as a control device, which is provided with an I/O device, a storage unit for storing control programs, control maps and the like, a central processing unit, timers, and counters. The ECU 61 comprehensively controls the in-cylinder injection engine 1. Detection information by the aforesaid various sensors is inputted in the ECU 61, which determines ignition timing, amount of introduced EGR gas and the like including fuel injection mode and fuel oil consumption on the basis of the detection information by various sensors to drivingly control the driver 20 for the fuel injection valve 4, ignition coil 19, EGR valve 37, and the like.

In this respect, on the input side of the ECU 61, a large number of switches (not shown) are connected in addition to the aforesaid various sensors, and on the output side thereof, various warning means and apparatus group (not shown) are also connected.

Figure 3:
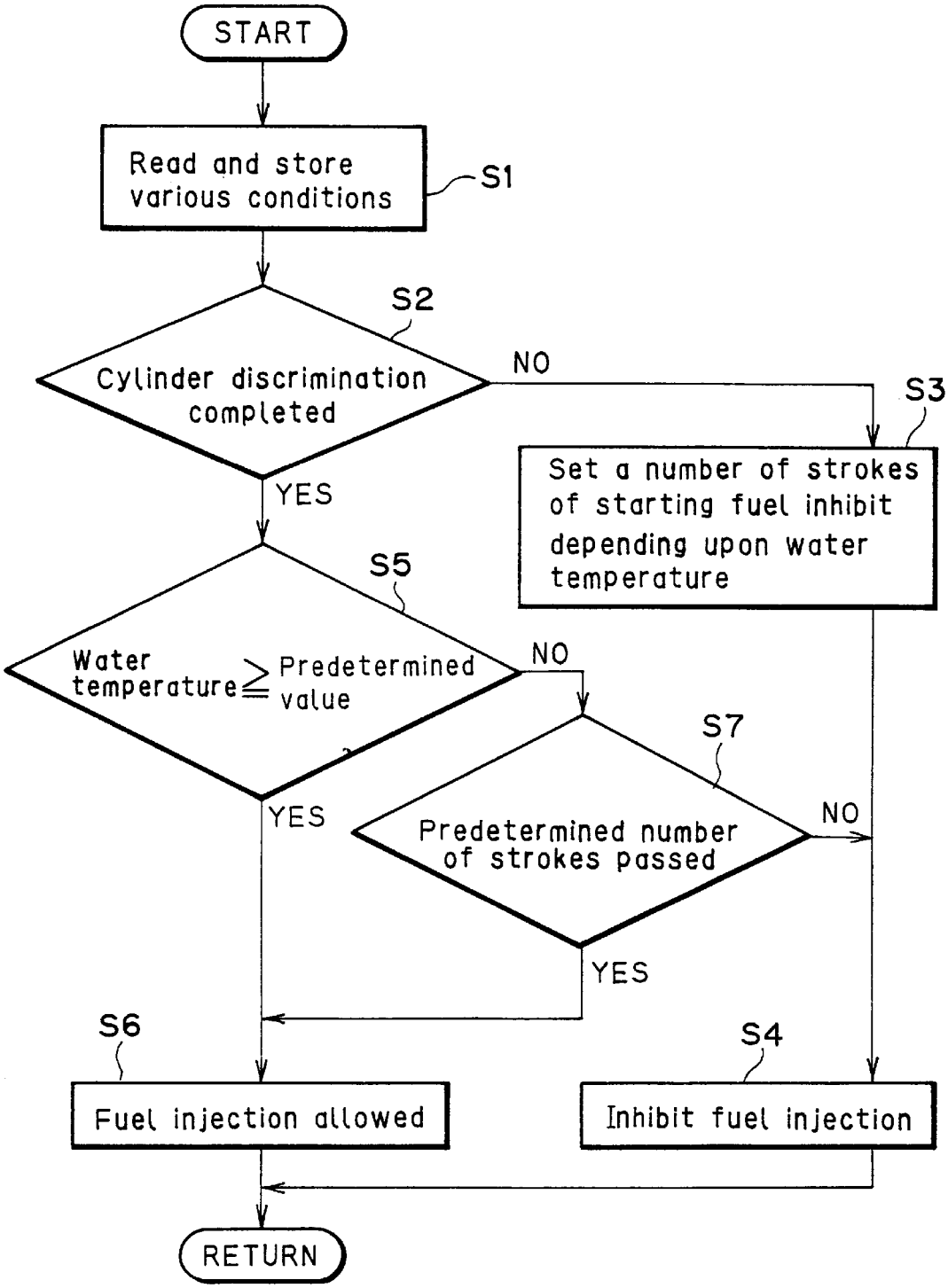
FIG. 3 is a flow chart showing fuel injection control at the time of starting.

In the aforesaid in-cylinder injection engine 1, when the driver turns on the ignition key (start detection means), the low-pressure fuel pump 42 and the fuel pressure selector valve 51 are turned on to supply fuel at low fuel pressure to the fuel injection valve 4. Next, when the driver operates the ignition key for starting, the sel-motor (not shown) cranks the in-cylinder injection engine 1 to, at the same time, start fuel injection control by the ECU 61. During starting of this in-cylinder injection engine 1, the control shown in FIGS. 2 and 3 is effected. In conjunction with FIGS. 2 and 3, the description will be made of fuel control during starting.

FIG. 2(*a*) shows a relationship between a cylinder discrimination signal SGC and a crank angle signal SGT; FIG. 2(*b*) shows a relationship between a stroke state and a fuel injection timing of the first cylinder; FIG. 2(*c*) shows a relationship between a stroke state and a fuel injection timing of the third cylinder; FIG. 2(*d*) shows a relationship between a stroke state and a fuel injection timing of the fourth cylinder; and FIG. 2(*e*) shows a relationship between a stroke state and a fuel injection timing of the second cylinder.

In FIG. 2(*a*), each rise portion of a crank angle signal SGT appears when the crankshaft is located at a position of 75 degrees BTDC, while each fall portion thereof appears when the crankshaft is located at a position of 5 degrees BTDC. The waveform of the cylinder discrimination signal SGC is set in such a manner that the cylinder discrimination signal SGC at the edge portion of the crank angle signal SGT is detected twice to thereby discriminate each cylinder by a combination of those levels (each cylinder discrimination means).

Also, in the waveforms of FIGS. 2(*b*) to 2(*e*), the pulses generated from near the end of the exhaust stroke to the intake stroke show the state of a driving pulse of the driver 20 for injecting fuel from the fuel injection valve 4. In this respect, the waveform of the cylinder discrimination signal SGC is not restricted to the example shown, but such waveform as to discriminate a specified cylinder by generating a pulse at a specified cylinder position may be used (cylinder detection means).

When the driver turns on the ignition key, the cylinder discrimination is effected. More specifically, as shown in FIG. 2(*a*), a crank angle signal SGT and a cylinder discrimination signal SGC are generated during starting to detect the state of a cylinder discrimination signal SGC at the leading edge and trailing edge of the crank angle signal SGT from the start of the processing. In the example shown, it is detected that the edge portion at 5 degrees BTDC of the first pulse of the crank angle signal SGT is on a low level, and the edge portion at 75 degrees BTDC of the second pulse is on a high level.

The waveform of a cylinder discrimination signal SGC is set in such a manner that a signal at the edge portion of the crank angle signal SGT can be detected twice to thereby discriminate each cylinder by a combination of those levels, and therefore, the cylinder discrimination is completed by the combination of those two detection levels.

Upon completion of the cylinder discrimination, fuel injection is started from a cylinder located near the end of the exhaust stroke. More specifically, in the example shown, fuel is first injected into the fourth cylinder shown in FIG. 2(*d*) (in the figure, indicated by dotted line), and thereafter fuel injection is sequentially effected in order of the second cylinder (in the figure, indicated by dotted line) in FIG. 2(*e*), the first cylinder (in the figure, indicated by solid line) in FIG. 2(*b*) and the third cylinder (in the figure, indicated by solid line) in FIG. 2(*c*).

In a cold state of the in-cylinder injection engine 1, there is a possibility that, when fuel injection is sequentially effected immediately after the starting as described above, vaporization of the fuel is still insufficient because the interior of the combustion chamber 5 is cold. In such a case, the fuel adheres to the ignition plug 3 and contaminate it, and the ignition plug 3 smolders, thus making it impossible to ignite. Thus, if the temperature of cooling water detected by the water temperature sensor 16 during starting is below a predetermined value even if the cylinder discrimination is completed, fuel injection is stopped within a predetermined period to raise the temperature within the combustion chamber 5, particularly the temperature of the ignition plug 3 and the fuel injection valve 4 by compression of the air resulting from the raised piston. Also, there is a possibility that a demanded amount of fuel cannot be attained because the fuel pressure is low during starting even if the fuel injection valve 4 is opened immediately after starting. Also, there is a possibility that, when the fuel injection valve 4 is opened, the fuel pressure, which has been rising, lowers again to make the rise of the fuel pressure slower. Thus, it is arranged such that within a predetermined period (for example, time until the fuel pressure within the low-pressure feed pipe becomes about 0.3 MPa as low fuel pressure) after starting is detected, fuel injection is stopped to increase the pressure of fuel.

The control for stopping fuel injection within a predetermined period, when the temperature of cooling water detected by the water temperature sensor 16 is below a predetermined value, will be described in conjunction with FIG. 3.

As shown in FIG. 3, various conditions are read in step S1, and the cooling water temperature in the in-cylinder injection engine 1 detected by the water temperature sensor 16 is stored. In step S2, it is determined whether or not the cylinder discrimination is completed, and since the cylinder discrimination has not been completed immediately after starting is commenced, the sequence will proceed to step S3.

In the step S3, a number of strokes of fuel injection inhibit during starting is set on the basis of the water temperature detected by the water temperature sensor 16. As shown by dotted line in the waveform of driving pulse in, for example, FIGS. 2(*d*) and (*e*), two strokes are so set as to inhibit fuel injection after the cylinder discrimination is completed. By inhibiting fuel injection by two strokes, at least one compression stroke is included in a predetermined period to raise the temperature within the combustion chamber 5 by the compression of air. In the step S3, a number of strokes of fuel injection inhibit is set, and thereafter, in step S4, the fuel injection will be inhibited.

If the cylinder discrimination is found to have been completed in the step S2, it is determined in step S5 whether or not the water temperature detected by the water temperature sensor 16 exceeds a predetermined value. If the water temperature is found in the step S5 to be not less than a predetermined value, fuel injection is allowed in step S6 to start fuel injection from a predetermined cylinder immediately. Fuel injection will be started from, for example, the position indicated by dotted line in the waveform of the driving pulse in FIGS. 2(*d*) and (*e*) immediately after the completion of cylinder discrimination.

If the water temperature is found in the step S5 to be below a predetermined value, it is determined in step S7 whether or not a number of strokes of fuel injection inhibit has passed a predetermined number of strokes. It is determined on the basis of the counted value or the like whether or not two strokes indicated by dotted line in the waveforms of driving pulse shown in, for example, FIG. 2(*d*) and (*e*) have passed. In this respect, the determination as to whether or not a number of strokes of fuel injection inhibit has passed a predetermined number of times can also be effected on the basis of a lapse of a predetermined time using a timer or the like.

If the number of strokes of fuel injection inhibit is found in the step S7 to be below the predetermined number of strokes, the sequence will proceed to the processing in the step S4 to inhibit fuel injection, and the processing is repeated until the number of strokes of fuel injection inhibit passes a predetermined number of strokes.

If the number of strokes of fuel injection inhibit is found in the step S7 to have passed a predetermined number of strokes, for example, if two strokes indicated by dotted line in the waveforms of driving pulse shown in FIG. 2(*d*) and (*e*) are found to have passed, fuel injection is allowed in the step S6 to sequentially effect the fuel injection during starting in order of the third cylinder of FIG. 2(*c*), the fourth cylinder of FIG. 2(*d*) and the second cylinder of FIG. 2(*e*) starting from the first cylinder of FIG. 2(*b*). Here, reason why fuel injection is inhibited at least between two strokes is that, since the first and third cylinders have surely been subjected to one compression stroke before the completion of the cylinder discrimination (at least two strokes are required according to the cylinder discrimination method of this embodiment), it can be judged that all cylinders have been subjected to one compression stroke when two strokes have passed after the cylinder discrimination.

When starting of the in-cylinder injection engine 1 is completed, idle rotation speed control based on opening/closing of the first air by-pass valve 25, or air-fuel ratio feedback control in response to the output voltage of the $O_2$ sensor 34 is started. Thereafter, after the completion of warming-up of the in-cylinder injection engine 1, the fuel injection mode is determined in correspondence with the opening of the throttle valve 29 and the engine rotation speed, and the fuel injection, supply of an amount of air and the like are controlled on the basis of the target air-fuel ratio and the target ignition timing for the fuel injection mode.

In the fuel injection mode, depending upon the operating condition of a vehicle, there are set, for example, a former-period lean mode in which fuel is injected in an intake stroke during the aforesaid starting, a latter-period lean mode in which fuel is injected in a compression stroke, a stoichio feedback mode in which fuel is injected so as to have a theoretical air-fuel ratio, an open loop mode in which a comparatively larger amount of fuel is injected, and a fuel cut mode in which fuel injection is stopped.

As described above, in the starting control of this embodiment, design is made such that when the driver turns on the ignition key (when starting has been detected), cylinder discrimination, in which each cylinder is discriminated, is effected; after each cylinder is discriminated, it is determined whether or not the water temperature detected by the water temperature sensor 16 exceeds a predetermined value; and when the water temperature is below the predetermined value, fuel injection is started from a cylinder subjected to at least one compression stroke. Therefore, it is possible to discriminate each cylinder quickly, to raise the temperature within the combustion chamber 5 due to compression stroke at low water temperature at which the starting ability tends to be deteriorated, and to improve the starting ability of the in-cylinder injection engine 1 at low water temperature while shortening the starting time.

After starting is detected, a cylinder subjected to at least one compression stroke is discriminated by the cylinder discrimination, and after a lapse of a predetermined period (for example, the time until the fuel pressure within the low-pressure feed pipe becomes about 0.3 MPa as low fuel pressure) until the fuel pressure rises, supply of fuel is started from a cylinder subjected to one compression stroke by the fuel supply means whereby it is possible to inject an amount of fuel corresponding to a demanded amount of fuel for valve opening time previously set from a cylinder whose temperature of the combustion chamber has been raised. Therefore, it is possible to prevent the exhaust gas quality from being deteriorated, and to improve the starting ability at low temperatures without injecting any futile fuel which is not useful for starting.

When the engine temperature is below a predetermined value in an internal-combustion engine having N pieces of cylinders, it is arranged to count a number of fuel-suppliable cylinders after the completion of the cylinder discrimination to start fuel injection from the [(N/2)+1]th fuel-suppliable cylinder, whereby the starting ability of the internal-combustion engine can be improved by effectively raising the temperature in the combustion chamber because at least one compression stroke can be included.

In the aforesaid embodiment, the description has been made of the example in which the present invention is applied to an in-cylinder injection engine 1 for directly injecting fuel into the combustion chamber 5 as an internal-combustion engine, but it is also possible to apply the present invention to an internal-combustion engine in which fuel is injected in the intake pipe, and the present invention can be applied to a single-cylinder engine and a V-type six-cylinder engine as well as a four-cylinder in-cylinder injection engine 1. In the case of the V-type six-cylinder engine, if three strokes are required to include at least one compression stroke, fuel injection may be inhibited for at least three strokes after the cylinder discrimination, and if two strokes are required for the cylinder discrimination, fuel injection may be inhibited for at least two strokes after the cylinder discrimination.

What is claimed is:

1. A control device for an internal-combustion engine, comprising:

fuel supply means for supplying fuel into combustion chambers for each cylinder of a multi-cylinder type internal-combustion engine respectively;

fuel control means for controlling said fuel supply means on the basis of the operating condition of said internal-combustion engine;

start detection means for detecting commencement of starting of said internal-combustion engine;

cylinder discrimination means for discriminating cylinders on the basis of timing signals at predetermined crank angle positions corresponding to said cylinders; and temperature detection means for detecting engine temperature of said internal-combustion engine, said fuel control means having starting injection commencement control means for starting fuel injection from a fuel-suppliable cylinder after cylinder discrimination is completed by said cylinder discrimination means at the commencement of starting of said internal-combustion engine, wherein said starting injection commencement control means controls, at the commencement of starting said internal-combustion engine, said fuel supply means so as to start fuel injection from a fuel-suppliable cylinder on the basis of cylinder discrimination carried out by said cylinder discrimination means when the engine temperature detected by said temperature detection means exceeds a predetermined temperature, and to start fuel injection from a fuel-suppliable cylinder subjected to at least one compression stroke on the basis of the cylinder discrimination after the cylinder discrimination carried out by said cylinder discrimination means when the engine temperature detected by said temperature detection means is below said predetermined temperature.

2. A control device for an internal-combustion engine as claimed in claim 1, wherein, subsequently to a cylinder in which fuel injection is started by controlling said fuel supply means by said starting injection commencement control means at the commencement of starting of said internal-combustion engine, said fuel control means controls said fuel supply means so as to sequentially inject fuel from a next fuel-suppliable cylinder discriminated by said cylinder discrimination means.

3. A control device for an internal-combustion engine as claimed in claim 1, wherein said starting injection commencement control means controls said fuel supply means so as to start fuel injection from a second fuel-suppliable cylinder after the completion of cylinder discrimination when said engine temperature is below said predetermined temperature.

4. A control device for an internal-combustion engine as claimed in claim 1, wherein said internal-combustion engine has N pieces of cylinders and said starting injection commencement control means has count means for counting a number of fuel-suppliable cylinders after the completion of cylinder discrimination when said engine temperature is below said predetermined temperature, and said starting injection commencement control means controls said fuel supply means so as to start fuel injection from a [(N/2)+1]th fuel-suppliable cylinder.

5. A control device for an internal-combustion engine as claimed in claim 1, wherein said internal-combustion engine is a four-stroke internal-combustion engine including each stroke of suction, compression, expansion and exhaust, and said starting injection commencement control means discriminates, in the cylinders for which the cylinder discrimination has been effected after the completion of the cylinder discrimination, when said engine temperature is below said predetermined temperature, at least two strokes of the strokes of said suction, compression, expansion and exhaust, and thereafter controls said fuel supply means so as to start fuel injection from the fuel-suppliable cylinder discriminated by said cylinder discrimination means.

6. A control device for an internal-combustion engine as claimed in claim 1, wherein said starting injection commencement control means sets a supply stop period until the start of fuel injection is allowed on the basis of said engine temperature at the commencement of starting of said internal-combustion engine, and controls said fuel supply means so as to start fuel injection from the fuel-suppliable cylinder discriminated by said cylinder discrimination means after a lapse of said supply stop period after the completion of the cylinder discrimination.

7. A control device for an internal-combustion engine as claimed in claim 6, wherein said internal-combustion engine is a four-stroke internal-combustion engine including each stroke of suction, compression, expansion and exhaust, and said supply stop period is a number of strokes of each stroke of said suction, compression, expansion and exhaust.

8. A control device for an internal-combustion engine as claimed in claim 6, wherein said supply stop period is a number of times of compression strokes of a cylinder subjected to a first compression stroke after the completion of the cylinder discrimination.

9. A control device for an internal-combustion engine as claimed in claim 1, wherein said internal-combustion engine is provided with fuel transport means, said fuel transport means includes a first fuel pump for delivering fuel, via a fuel passage, to delivery pipe connected to said fuel supply means, and a first regulator disposed in said fuel passage downstream of said first fuel pump and for adjusting pressure of fuel delivered by said first fuel pump to a first set pressure, and said starting injection commencement control means allows fuel injection after a lapse of a predetermined period until fuel pressure within said delivery pipe reaches said first set pressure.

10. A control device for an internal-combustion engine as claimed in claim 9, wherein said fuel transport means includes a second fuel pump provided midway in said fuel passage between said delivery pipe and said first regulator, for delivering fuel pressure-adjusted by said first regulator; a second regulator provided in said fuel passage downstream of said second fuel pump, for adjusting fuel delivered by said second fuel pump to a second set pressure higher than said first set pressure; and a fuel pressure control valve provided in a by-pass passage for bypassing said second regulator in said fuel passage downstream of said second fuel pump, for being opened or closed electrically, so as to release said fuel pressure control valve in a specified operating state including during starting of said internal-combustion engine and to control the fuel pressure within said delivery pipe from said second set pressure to said first set pressure.

11. A control device for an internal-combustion engine as claimed in claim 10, wherein said fuel supply means has an injector capable of directly supplying fuel into said combustion chamber, and said internal-combustion engine is operable in a compression stroke injection mode for mainly injecting fuel in the compression stroke and in a suction stroke injection mode for mainly injecting fuel in the suction stroke, and is provided with injection mode selection means for selecting either said compression stroke injection mode or said suction stroke injection mode depending on the operating condition of said internal-combustion engine, and said injection mode selection means selects said suction stroke injection mode when commencement of starting of said internal-combustion engine is detected by said start detection means, and said fuel control means sets the valve opening time of said injector on the basis of the demand injection quantity corresponding to a target air-fuel ratio, and said first set pressure at the commencement of starting of said internal-combustion engine.

12. A control method for an internal-combustion engine provided with fuel supply means for supplying fuel into combustion chambers for each cylinder of a multi-cylinder type internal-combustion engine respectively, and fuel control means for controlling said fuel supply means on the basis of the operating condition of said internal-combustion engine, comprising the steps of:

(a) detecting commencement of starting of said internal-combustion engine;

(b) discriminating cylinder on the basis of timing signals at the predetermined crank angle positions corresponding to said cylinders;

(c) detecting the engine temperatures of said internal-combustion engine;

(d1) when the engine temperature detected in said step (c) is below a predetermined temperature after commencement of starting of said internal-combustion engine is detected in said step (a), discriminating a fuel-suppliable cylinder subjected to at least one compression stroke after the cylinder discrimination carried out in said step (b), and further identifying the fuel-suppliable cylinder as a fuel-supply starting cylinder; and (*e*) controlling said fuel supply means so as to effect fuel injection from the fuel-supply starting cylinder identified in said step (d1).

13. A control method for an internal-combustion engine as claimed in claim 12, wherein said step (d1) includes the following step:

(d2) discriminating a second fuel suppliable cylinder after the cylinder discrimination carried out in said step (b), and further identifying said second fuel suppliable cylinder as the fuel-supply starting cylinder.

14. A control method for an internal-combustion engine as claimed in claim 12, wherein said internal-combustion engine has N pieces of cylinders, and said step (d1) further includes the following step:

(d3) counting a number of fuel suppliable cylinders after the cylinder identification carried out in said step (b), discriminating the [(N/2)+1]th fuel suppliable cylinder, and further identifying said [(N/2)+1]th cylinder as the fuel-supply starting cylinder.

15. A control method for a multi-cylinder type internal-combustion engine as claimed in claim 12, wherein said step (d1) further includes the following steps:

(f1) setting a supply stop period until fuel injection is allowed on the basis of the engine temperature detected in said step (c);

(f2) counting the supply stop period set in said step (f1) after the cylinder discrimination carried out in the step (b); and (f3) discriminating a fuel-suppliable cylinder on the basis of the cylinder discrimination carried out in the step (b) after the supply stop period has been completed in said step (f2), and identifying said fuel-suppliable cylinder as the fuel-supply starting cylinder.

16. A control method for a multi-cylinder type internal-combustion engine as claimed in claim 15, wherein said supply stop period in said step (f1) should be a number of strokes for each stroke of suction, compression, expansion and exhaust until fuel injection is allowed on the basis of the engine temperature detected in said step (c).

17. A control method for a multi-cylinder type internal-combustion engine as claimed in claim 15, wherein said supply stop period in said step (f1) should be a number of times of compression strokes of a cylinder subjected to a first compression stroke after the completion of cylinder discrimination until fuel injection is allowed on the basis of the engine temperature detected in said step (c).

18. A control method for a multi-cylinder type internal-combustion engine as claimed in claim 12, wherein said step (d1) further includes the following steps:

(g1) setting a predetermined period until the fuel pressure within the delivery pipe becomes a first set pressure which is the fuel pressure of the fuel pressure-adjusted by a first regulator and said predetermined period is a period until fuel injection is allowed;

(g2) counting the predetermined period set in said step (g1) after the cylinder discrimination carried out in the step (b); and (g3) when the counting-completed time in which counting of the predetermined period has been completed in said step (g2) is earlier than injection-starting time at which a fuel-suppliable cylinder subjected to at least one compression stroke on the basis of the cylinder discrimination carried out in said step (b) starts fuel supply, identifying said fuel-suppliable cylinder as a fuel-supply starting cylinder.

19. A control method for an internal-combustion engine as claimed in claim 12, wherein said step (d1) further includes the following step:

(h) when the engine temperature detected in said step (c) exceeds said predetermined temperature after commencement of starting of said internal-combustion engine is detected in said step (a), identifying the first fuel-suppliable cylinder after the cylinder discrimination carried out in said step (b) as a fuel-supply starting cylinder.

* * * * *